US007030519B2

(12) United States Patent
Slettenmark

(10) Patent No.: US 7,030,519 B2
(45) Date of Patent: Apr. 18, 2006

(54) ELECTRODYNAMIC ACTUATOR

(75) Inventor: Bruno Slettenmark, Järfälla (SE)

(73) Assignee: Maquet Critical Care AB, (SE)

( * ) Notice: Subject to any disclaimer, the term of this patent is extended or adjusted under 35 U.S.C. 154(b) by 81 days.

(21) Appl. No.: 10/701,806

(22) Filed: Nov. 5, 2003

(65) Prior Publication Data

US 2004/0095128 A1 May 20, 2004

(30) Foreign Application Priority Data

Nov. 20, 2002 (CH) ..... 0203429

(51) Int. Cl.
*H02K 41/00* (2006.01)

(52) U.S. Cl. ..... 310/12

(58) Field of Classification Search ..... 381/83, 381/93, 96, 111, 117, 400, 406; 310/12–14
See application file for complete search history.

(56) References Cited

U.S. PATENT DOCUMENTS 4,569,072 A * 2/1986 van Roermund ..... 381/7
4,690,371 A 9/1987 Bosley et al. ..... 251/65
5,197,104 A 3/1993 Padi ..... 381/96
5,353,174 A * 10/1994 Uno ..... 360/78.06
5,600,237 A 2/1997 Nippert ..... 324/207.16
5,783,924 A * 7/1998 Kahlman ..... 318/601
5,942,892 A 8/1999 Li ..... 324/207.16
6,111,741 A 8/2000 Schmitz et al. ..... 361/143

FOREIGN PATENT DOCUMENTS

WO WO 95/31241 11/1995
WO WO 00/52715 9/2000

* cited by examiner

*Primary Examiner*—Darren Schuberg
*Assistant Examiner*—Judson H. Jones
(74) *Attorney, Agent, or Firm*—Schiff Hardin LLP

(57) ABSTRACT

An electrodynamic actuator has a permanently magnetic stationary part that forms an air-core with a magnetic field, and an armature with a coil arranged in the air-core. The armature moves in the magnetic field in the air-core dependent on a drive current fed to the coil. An increased accuracy is achieved by the provision of damping in relation to the speed of the armature, by arranging a sensing winding on the armature and connecting a calculation unit to the sensing winding. The calculation unit determines the speed of the armature from an induced voltage in the sensing winding caused by a movement of the armature in the magnetic field.

10 Claims, 2 Drawing Sheets

ELECTRODYNAMIC ACTUATOR

BACKGROUND OF THE INVENTION

1. Field of the Invention

The present invention relates to an electrodynamic actuator of the type having a permanently magnetic stationary part that forms an air-core with a magnetic field therein, and an armature with a coil disposed in the air-core, the armature moving in the magnetic field in the air-core dependent on a drive current that is fed to the coil.

2. Description of the Prior Art

Electrodynamic actuators are often employed, for example, in the control of valves for regulating a gas flow in medical ventilators and other related devices.

One type of electrodynamic actuator, often referred to as a voice coil, has a permanently magnetic stationary part, designed to form an air-core (air gap). A relatively constant magnetic field exists in this air-core. An armature is arranged in this air-core. The armature carries a coil. By sending a driving current through the coil in the magnetic field, a force is imparted to the armature that is essentially proportional to the current.

In order to achieve a highly accurate and stable control it is necessary to provide the actuator with a viscous damping, i.e. a damping that is proportional to the speed of the armature. The damping may be either mechanical or electronic.

With electronic damping a determination of the speed is a key factor in achieving the possibility of high accuracy in the damping and thereby in the regulation of the moving part.

SUMMARY OF THE INVENTION

An object of the present invention is to provide an electrodynamic actuator that, in a simple and a reliable manner can determine the speed of the armature and thereby determine a damping of the actuator that provides an optimal regulation.

The above object is achieved in accordance with the principles of the present invention in an electrodynamic actuator of the type initially described, wherein a sensing winding is disposed on the armature, with a calculation unit connected to the sensing winding, the calculation unit determining a speed of movement of the armature from an induced voltage in the sensing winding caused by movement of the armature in the magnetic field.

An induced voltage that is directly proportional to the magnetic field, the coil diameter, the number of turns and the speed of the armature in the magnetic field is achieved by the use of a sensing winding that may be wound on, beneath or beside the coil winding. Thus, with a constant magnetic field, (As in principle the magnetic field in this type of actuator is), the voltage will be directly proportional to the speed. In this configuration the drive current through the coil influences the magnetic field in the magnetic circuit only to a small extent. The sensing winding may be formed with a very small diameter wire since a very small current will load the winding.

This type of configuration is not, however, itself problem free. A significant problem that exists with this design is the perturbation of the desired speed signal that is caused by an additional induced voltage in the sensing winding. This additional induced voltage is caused by variations in the drive current and the mutual inductance of both windings.

In an embodiment, compensation is made in the determination of the speed (and thereby the determination of a suitable damping) for error signals resulting from the mutual inductance between the coil and the sensing winding. A change in the drive current in the coil induces a voltage in the sensing winding. More precisely, the compensation is determined from the derivative of the drive current multiplied by an "induction factor" and is a direct measure of the error signal that is to be eliminated. The derivative of the drive current is employed since the drive current is directly accessible and at the same time is directly proportional to the magnetic field from the coil. The "induction factor" may be obtained by calibrating the actuator at different drive currents with the moving part held stationary. The calibrated value shall then result in a zero signal (with the armature stationary with respect to the magnetic field then no voltage should be induced in the sensing winding).

The actuator also may be advantageously designed so that a compensation for capacitive cross-talk between the coil and the sensing winding can be determined. The capacitive cross-talk may be modeled as a discrete capacitance between the coil and the sensing winding. Integrating the drive current and dividing the integral by the discrete capacitance then attain a suitable compensation. A calibration can be carried out to determine the capacitive compensation in a manner equivalent to that described above.

In one embodiment the suitable damping signal is determined and is then applied to the drive current.

DESCRIPTION OF THE PREFERRED EMBODIMENTS

Figure 1:
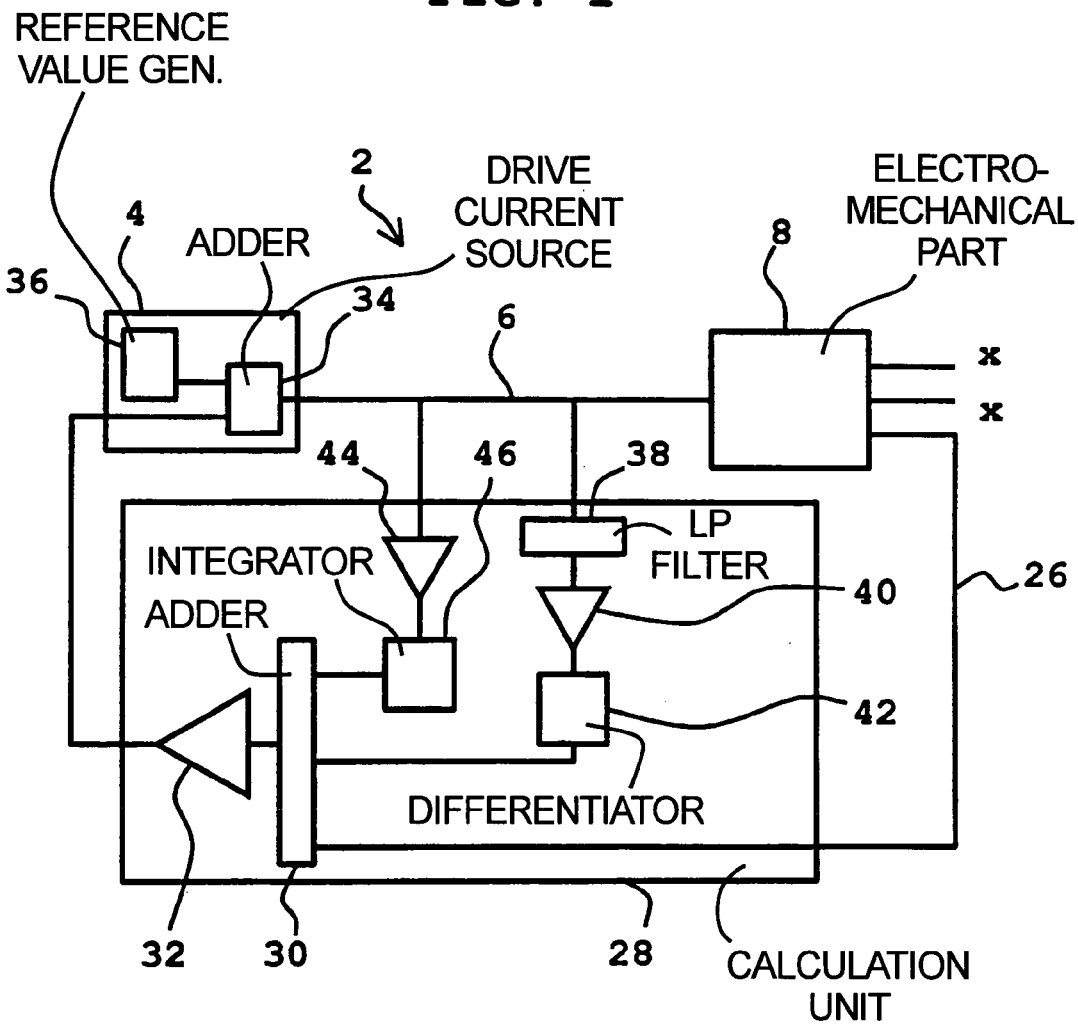
FIG. 1 is a schematic block diagram of an actuator according to the invention.

An electrodynamic actuator 2 is shown schematically in FIG. 1. The actuator 2 has a drive current source 4 that supplies a drive current, via a drive conductor 6, to an electromechanical part of the actuator indicated by the reference numeral 8.

Figure 2:
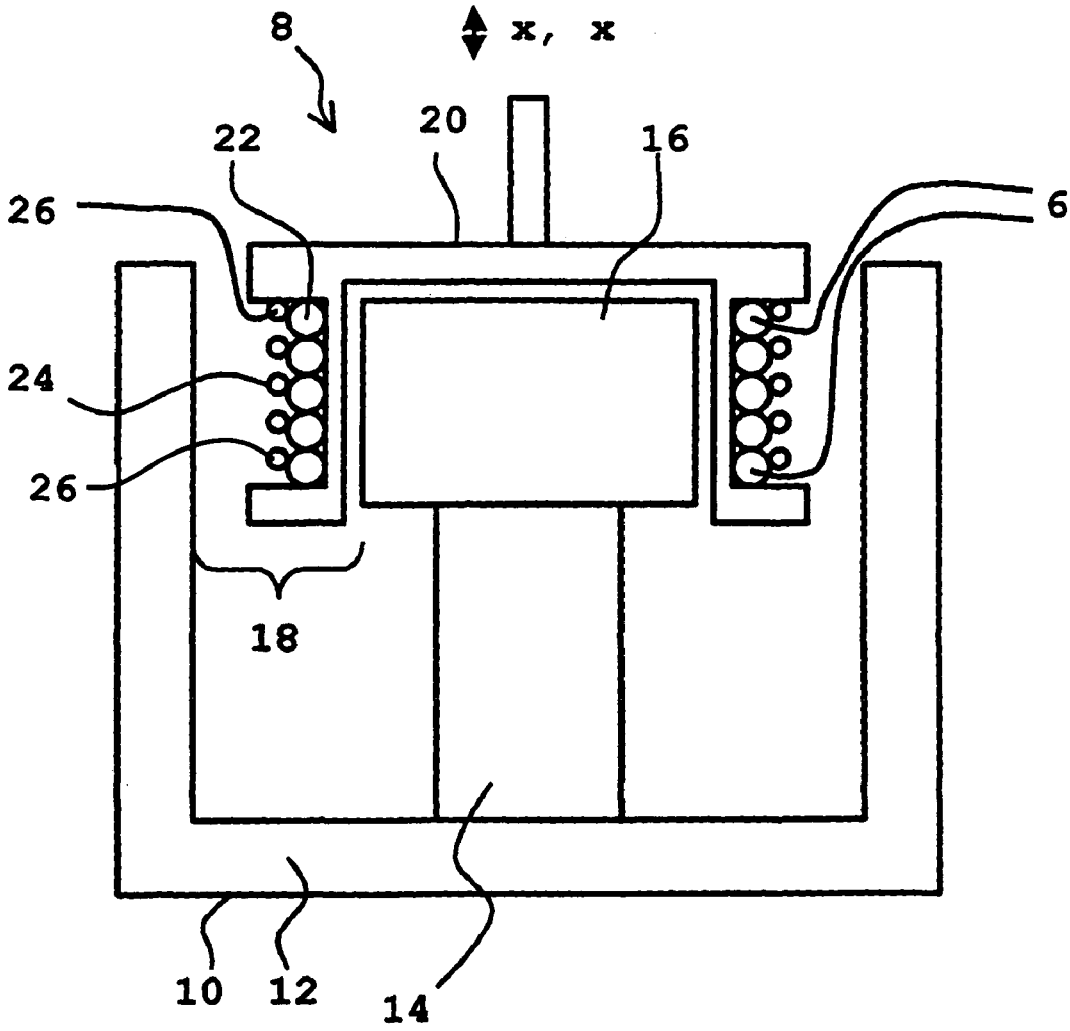
FIG. 2 is a schematic illustration of the mechanical components of the actuator.

The design of the electromechanical part 8 is shown in FIG. 2, from which it can be seen that the electromechanical part 8 has a permanently magnetic stationary part 10, that in the present embodiment is divided into an outer part 12, a permanent magnet 14, and an inner part 16. The inner part 16 and the outer part 12 together forms an air-core 18. The air-core 18 is preferably tubular. The permanent magnet 14 generates a magnetic field in the air-core 18. The inner part 16 and the outer part 12 are advantageously formed of a soft-ferromagnetic material. The magnetic field then in principle passes through the air-core 18 in a radial direction and is essentially constant as a function of the axial coordinate in the air-core 18.

An armature 20 is arranged in the air-core 18. This armature 20 carries a coil 22 that receives the drive current from the drive conductor 6. When the drive current flows through the coil 22 the armature 20 is influenced by a force that is essentially proportional to the driving current, causing a positional change of the armature 20, which in FIGS. 1 and 2 is represented by a position x and a speed $\dot{x}$.

In order to achieve a high degree of accuracy in the regulation of the generated movement (and which in many applications for valve regulation can in principle be equated to accuracy in the position, x) the armature 20 of the actuator requires a damping force that is proportional to the speed $\dot{x}$.

A sensing winding 24 is arranged on the armature 20 for use in determining the speed $\dot{x}$. The sensing winding 24 may be, in principle, formed of a secondary coil wound on the same bobbin as the coil 22. The sensing winding 24 can, in this respect, be wound beneath, on top of, against or interwoven with, the coil 22. The sensing winding 24 may use a very thin wire, since it will be only carrying a very small current.

When the armature 20 moves in the magnetic field in the air-core 18 a voltage will be induced in the sensing winding 24. This voltage can be emitted at an output 26.

The thus-determined voltage is, with reference to FIG. 1, transferred to a calculation unit 28. Within the calculation unit 28 this value is supplied to an adder 30 and on to an output amplifier 32 to generate a damping signal that is fed to an adder 34 in the drive current source 4. A reference value from a reference value generator 36 is also supplied to the adder 34 wherein the reference value is modified using the damping value from the calculation unit 28 so that the drive current provides a regulation having the desired character.

It should be noted that the adder 34 could equally well be a subtractor. The mathematical operation (addition or subtraction) is dependent on the signs of the signals that are to be combined. Addition with a negative signal is in reality a subtraction and subtraction with a negative signal is in reality an addition. In the present case the damping value will always be added to the drive current in a manner that decelerates the moving armature 20.

In order to compensate for inductive and capacitive interference there are two compensation branches within the calculations unit 28.

The first branch compensates for the unwanted induced voltage in the sensing winding that arises when the drive current in the coil varies to generate the desired force/motion. The induced voltage is proportional to the derivative of the magnetic flux from the coil. The magnetic flux is, in its turn, proportional to the drive current. The compensation may therefore be based on the derivative of the drive current to the coil.

The drive current is diverted to a suitably adapted low-pass filter 38 for (any) compensation for a frequency dependent mutual inductance. The mutual inductance may decrease with increasing frequency in the presence of metallic material (for example the inner part 16) due to induced eddy currents and flux expulsion. Ideally, the low-pass filter 38 has essentially exactly the same frequency dependency as the mutual inductance. A first amplifier 40 amplifies the signal with an "induction factor" that suitably may be determined through calibrating the actuator with the moving part held stationary. When the moving part is stationary and fed with a time carrying drive current no signal should arise since the velocity is zero and thus the damping value should be zero. The calibration thus includes varying the "induction factor" until a zero signal is attained after output amplifier 32. The signal then passes to a differentiator 42 that differentiates the signal. The thus filtered, amplified and differentiated signal is forwarded to the adder 30 where it modifies the signal from the output 26.

The second compensation branch compensates for capacitive cross-talk between the coil and the sensing winding. A discrete value for the distributive capacitances between these may be calculated or empirically determined. The drive current is divided by this discrete value in a second amplifier 44, after which the signal is integrated in an integrator 46. The integrated signal is forwarded to the adder 30 for additional compensation of the damping signal. The exact capacitance factor is determined in the same way as described above with the moving part held stationary, and adjusting the output of output amplifier 32 to a minimum value. In practice, it may be necessary with am iterative procedure varying both the "induction factor" and the "capacitive factor" alternatingly until a minimum close to zero is found.

The above described determinations and compensations in the calculations unit may be achieved in software, hardware or a combination of the two. The calculation unit thus need not be formed as a physical unit but may be functionally dispersed among different physical components in the actuator.

It is to be noticed that in the description above the damping factor has been viewed as a constant. The damping factor may, however, also be an adaptive factor varying with time with respect to the waveform of the drive current and/or the speed of the moving armature.

Although modifications and changes may be suggested by those skilled in the art, it is the intention of the inventor to embody within the patent warranted hereon all changes and modifications as reasonably and properly come within the scope of his contribution to the art.

I claim:

1. An electrodynamic actuator comprising:

a permanently magnetic stationary part forming an air-core with a magnetic field therein;

an armature disposed in said air-core, said armature carrying a coil adapted to be fed with drive current to cause said armature to move in said magnetic field in said air-core;

a sensing winding disposed on said armature, said sensing winding interacting with said magnetic field during movement of said armature to generate an induced voltage, said induced voltage being disturbed by changes in said drive current; and a calculation unit connected to said sensing winding, said calculation unit calculating a speed of movement of said armature from said induced voltage, said calculation unit, in determining said speed of movement of said armature, compensating for said disturbance by determining an induction compensation as a derivative of said drive current multiplied by an induction factor.

2. An electrodynamic actuator as claimed in claim 1 wherein said calculation unit employs a constant, as said induction factor, determined in a calibration with said coil disposed stationary in said air-core.

3. An electrodynamic actuator as claimed in claim 1 wherein said calculation unit employs a constant, as said induction factor, derived from a mutual inductance between said coil and said sensing winding.

4. An electrodynamic actuator as claimed in claim 1 wherein said calculation unit generates a damping signal directly proportional to said speed of movement of said armature, and causes said damping signal to modify said drive current.

5. An electrodynamic actuator comprising:

a permanently magnetic stationary part forming an air-core with a magnetic field therein;

an armature disposed in said air-core, said armature carrying a coil adapted to be fed with drive current to cause said armature to move in said magnetic field in said air-core;

a sensing winding disposed on said armature, said sensing winding interacting with said magnetic field during movement of said armature to generate an induced voltage, said coil and said sensing winding exhibiting a frequency-dependent mutual inductance; and a calculation unit connected to said sensing winding, said calculation unit calculating a speed of movement of said armature from said induced voltage, and said calculation unit, in calculating said speed of movement of said armature, compensating for said frequency-dependent mutual inductance, and including a low-pass filter with a frequency dependency essentially identical to said frequency-dependent mutual inductance.

6. An electrodynamic actuator as claimed in claim 5 wherein said calculation unit generates a damping signal directly proportional to said speed of movement of said armature, and causes said damping signal to modify said drive current.

7. An electrodynamic actuator comprising:

a permanently magnetic stationary part forming an air-core with a magnetic field therein;

an armature disposed in said air-core, said armature carrying a coil adapted to be fed with drive current to cause said armature to move in said magnetic field in said air-core;

a sensing winding disposed on said armature, said sensing winding interacting with said magnetic field during movement of said armature to generate an induced voltage said coil and said sensing winding exhibiting capacitive cross-talk between said coil and said sensing winding; and a calculation unit connected to said sensing winding, said calculation unit calculating a speed of movement of said armature from said induced voltage, and said calculation unit, in determining said speed of movement of said armature, compensating for said capacitive cross-talk.

8. An electrodynamic actuator as claimed in claim 7 wherein said calculation unit compensates for said capacitive cross-talk by obtaining an integral of said drive current multiplied by a capacitance factor.

9. An electrodynamic actuator as claimed in claim 8 wherein said calculation unit employs a constant, as said capacitance factor, that is an inverse of a distributed capacitance between said coil and said sensing winding.

10. An electrodynamic actuator as claimed in claim 7 wherein said calculation unit generates a damping signal directly proportional to said speed of movement of said armature, and causes said damping signal to modify said drive current.

* * * * *